US005519894A

United States Patent [19]

Imboden et al.

[11] Patent Number: 5,519,894

[45] Date of Patent: May 28, 1996

[54] PANTY GARMENT

[75] Inventors: Walter H. Imboden, Burlington; Jonathan M. Myers, Winston-Salem; Donald M. Caudle, Lewisville, all of N.C.

[73] Assignee: Sara Lee Corporation, Winston-Salem, N.C.

[21] Appl. No.: 337,091

[22] Filed: Nov. 10, 1994

[51] Int. Cl.[6] ..... A41B 9/04; A41B 11/04

[52] U.S. Cl. ..... 2/409; 2/243.1; 66/178 R; 66/171

[58] Field of Search ..... 2/409, 239, 227, 2/243.1, 400, 401, 402, 403, 404, 405, 406, 407, 408; 66/178 R, 179, 180, 182, 189, 171

[56] References Cited

U.S. PATENT DOCUMENTS

| | | | |
|---|---|---|---|
| 1,206,979 | 12/1916 | Belton | 2/409 X |
| 3,247,684 | 4/1966 | Hibbert, Jr. | 66/178 R |
| 3,595,034 | 7/1971 | Safrit | 2/409 X |
| 4,101,982 | 11/1978 | Muller | 2/409 |
| 4,807,304 | 2/1989 | McCants-Reed | 2/409 X |
| 4,875,241 | 10/1989 | Browder, Jr. et al. | 2/409 |
| 5,014,364 | 5/1991 | Orr | 2/409 X |

*Primary Examiner*—Jeanette E. Chapman

[57] ABSTRACT

A panty garment, panty hose or the like where the garment is formed from first and second adjacent, circularly knit and identically configured tubes each having a first panty section and a second panty section each of which are slit along part of their length at different locations so that when joined at edges thus formed provide a front panty portion made up of substantially all of the first panty sections and a rear panty portion made up of substantially all of the second panty sections, the yarns being knit in each of the sections to permit more vertical stretch in the rear panty section than in the front panty section when the garment is worn.

15 Claims, 2 Drawing Sheets

PANTY GARMENT

BACKGROUND OF THE INVENTION

1. Field of the Invention

The present invention relates generally to seamless knit tubes for use in forming a body garment and more particularly to a panty garment wherein front and rear panty portions utilize dissimilar slitting and different loop constructions to provide firm support and greater vertical stretch in the rear panty portion than in the front panty portion when the garment is worn.

2. Description of the Prior Art

Garments may be designed to provide special fit characteristics by a change in stitch construction at specific locations. In particular, nether garments formed from a pair of tubular knitted members have been provided with some shaping and stretching characteristics by a change in knitted structure during the knitting operation of the individual tubes. See for example, U.S. Pat. No. 3,824,812, disclosing a panty garment where the panty is knitted with less courses at its lateral portions than at its front and rear portions so as to cause the lateral portions to be drawn together wale-wise so that the lower ends of the lateral portions will be above the crotch of the wearer.

More recently, a panty garment has been developed utilizing first and second circularly and oppositely configured knit tubes to form a front panty section of one configuration and a back panty section of a differing configuration with the yarns knit in stitch loop constructions to permit more vertical stretch in the rear panty section than in the front panty section when the garment is worn.

There is a continuing need to develop garments of this nature having more specific fit characteristics and utilizing more efficient manufacturing techniques, as well as less complicated knitting machinery. It is to that objective that the present invention is directed.

OBJECTIVES AND SUMMARY OF THE INVENTION

It is, therefore, an objective of the present invention to provide a panty garment offering firm support and superior fit characteristics through the knitting process when the garment is made.

Another objective of the present invention is to provide a panty garment having more vertical stretch in the rear panty section than in the front panty section when the garment is worn.

Yet another objective of the present invention is to provide a pantyhose garment of the type described utilizing two identically formed but differently slit seamless circular knit tubes which, when joined, form the present panty garment.

It is yet still a further objective of the present invention to provide a panty garment of the type described having all and more of the advantages of prior art garments and none of the disadvantages.

A panty garment comprising the present invention is formed by combining first and second identical circular knitted tubes disposed side-by-side and slit at least along a part of their length and joined to the edges formed by the slitting operation to provide a front panty portion and rear panty portion. Each tube has a first panty section and a second panty section formed of reinforced yarns, the sections being adjacent each other and slit at separate locations to form a panty garment wherein the front panty portion is made up of substantially all of the first panty sections of both tubes and the rear panty portion is made up of substantially all of the second panty sections of both tubes, the yarns of the front and rear panty sections being knit so that more vertical stretch is experienced in the rear panty portion than in the front panty portion when the garment is worn.

Thus, there has been outlined in summary form the more important features of the invention in order that the detailed description that follows may be better understood and in order that the present contribution to the art may be better appreciated. There are obviously additional features of the invention that will be described hereinafter and which will form the subject matter of the claims appended hereto. It is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the present invention. It is also to be understood that the abstract is neither intended to define the invention of the application, which is measured by the claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages and the specific objects obtained by its use, reference should be made to the accompanying drawings and descriptive matter in which like characters of reference designate like parts throughout the several views.

DETAILED DESCRIPTION OF THE PREFERRED EMBODIMENT

Figures 1, 2, 3:
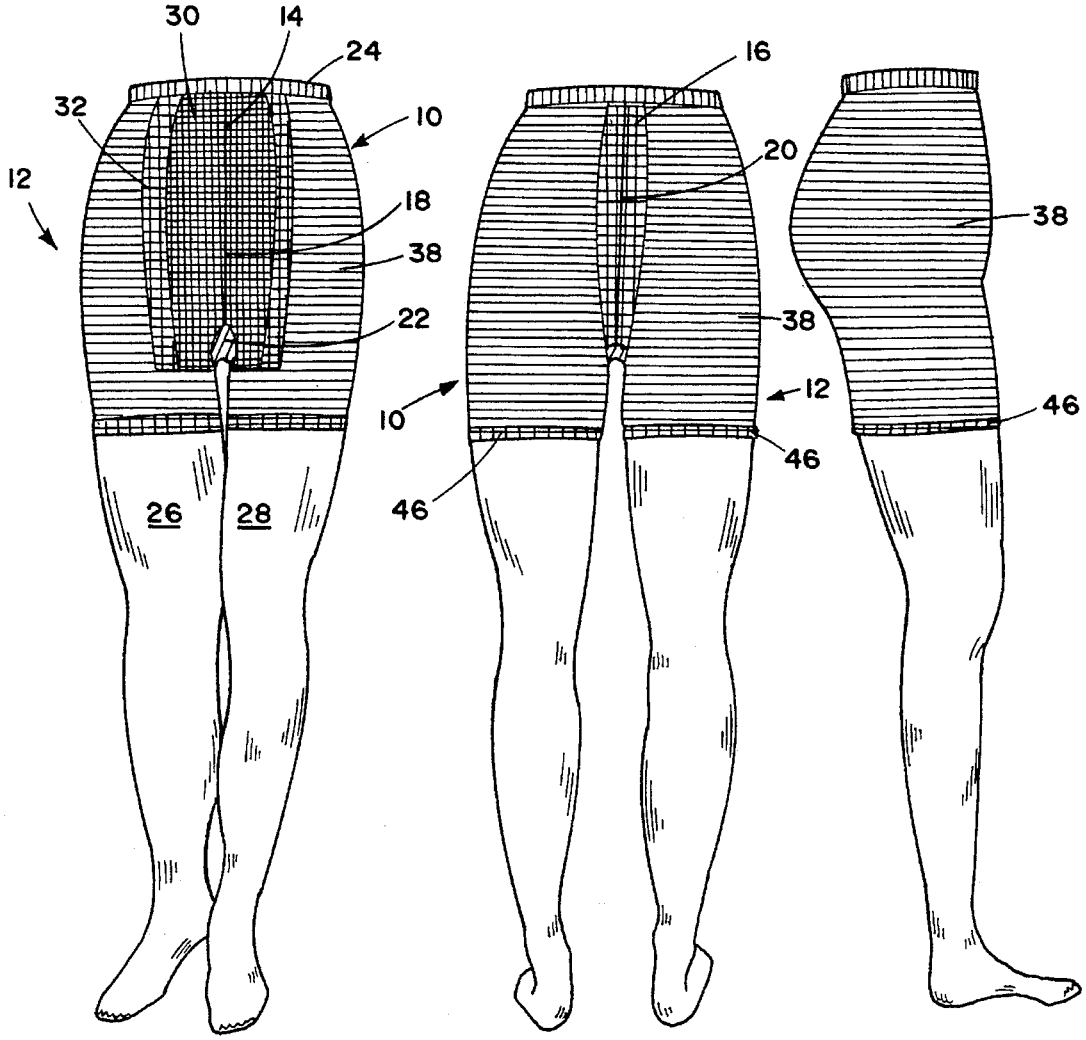
FIG. 1 is a frontal view of the panty garment comprising the present invention as seen on a wearer showing the front panty portion of the panty garment containing substantially all of the first panty sections of the two knit tubes.
FIG. 2 is a back view of the garment of FIG. 1 showing the rear panty portion of the panty garment containing substantially all of the second panty sections of the knit tubes.
FIG. 3 is a side view of the garment shown in FIGS. 1 and 2.

Referring now to the drawings, FIGS. 1–3 illustrate one embodiment of the panty garment incorporating the present invention which includes two seamless circularly knit tubes 10,12 with the upper part of each tube being slit downwardly to provide an edge 14 along the front of tubes 10,12 and an edge 16 along the rear of tubes 10,12. The edges are joined at a seam 18 at the front of the garment and a seam 20 at the rear of the garment. A crotch portion 22 may or may not be included.

An elastic band 24 serves as a waistband for the garment, and leg portions 26,28 extend downwardly from the lower part of the panty garment.

Each tube 10,12 has a first panty section 30 formed from a multiplicity of courses of a first stitch loop construction and from a reinforced yarn and a second panty section 32 formed from a multiplicity of courses of a second stitch loop construction and from a reinforced yarn. The first panty section is formed in a single location (FIG. 4) within tubes 10,12, and the second panty section 32 is formed in two parts at two different locations, each part positioned on a side 34,36 of first panty section 30 as shown. Sides 34,36 become junction lines between the first and second panty sections and serve as guides for the slitting operation when tubes 10,12 are slit along part of their length.

In forming the panty garment comprising the present invention, one of the knitted tubes 10, which forms, for example, the left side of the garment, is cut along side or junction 34, and the other knitted tube forming the right side of the garment is cut along side or junction 36 so that the two identically constructed tubes have differing slit locations. Thus tube 10 is slit along one junction of the adjacent first and second panty sections and tube 12 is slit along the other junction of the adjacent first and second panty sections. When the edges formed by the slitting operations are joined, a front panty portion includes essentially all of the first panty sections 30 of both tubes 10,12 and a rear panty portion contains essentially all of the second panty sections 32 of tubes 10,12.

Figure 4:
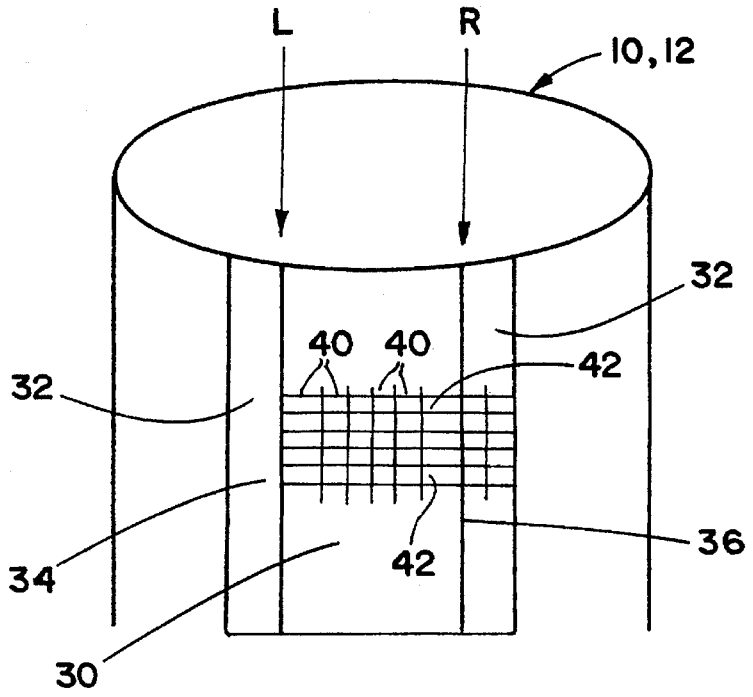
FIG. 4 is a schematic and fragmentary view of a pantyhose garment drawn to illustrate one embodiment of stitch configurations useable therein.

The regular portion of the panty 38 of the panty garment comprising the present invention is usually formed of a multiplicity of yarn courses of a jersey stitch loop construction although other stitch loop configurations may be employed. The stitch loop construction of the first panty section 30 is shown in FIG. 4 for a ladies fashion hosiery circular knitting machine utilizing four yarn feeds wherein wales 40 and courses 42 receive special stitches to give the resulting fabric particular fit characteristics. For purposes of illustrating the present inventive concept, note in FIG. 4 the provision of numerals 1–4 to represent yarn feeds in 4 courses and the provision of the designation "x" to represent tuck loops. The absence of a marker in any wale/course intersection represents a jersey loop.

In a preferred embodiment, tuck loops are provided in alternate wales 1 and 3, however, they are varied so that the tuck loops of course 3 do not coincide with the tuck loops of course 1 in the same wale. The pattern repeats every four courses.

Figure 5:
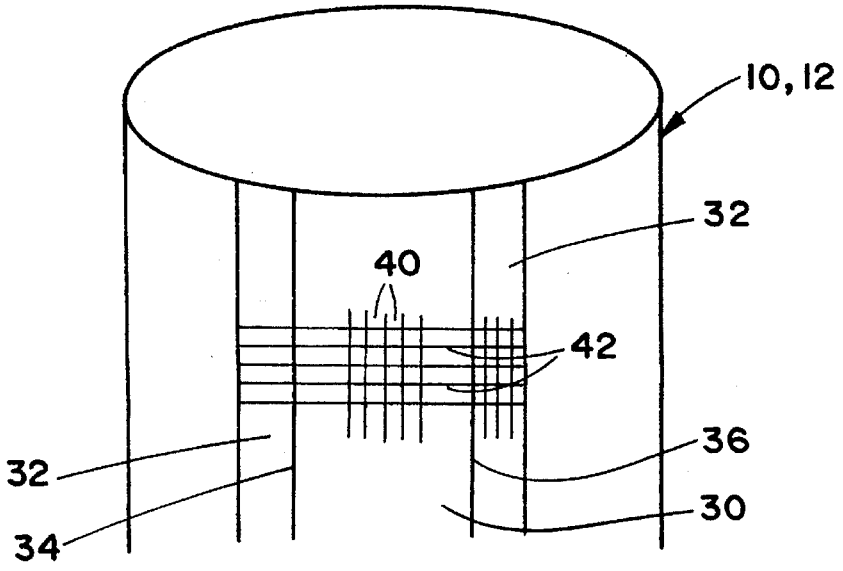
FIG. 5 is a schematic view of an alternative stitch configuration useable in the garment comprising the present invention.

In a second stitch loop construction shown in FIG. 5, tuck loops are provided only in alternate wales of course 1. In a variation of this embodiment, tuck loops may be provided in a single course in alternate wales and may be varied so that the tuck loops of course 1 of a 4 course rotation do not coincide with the tuck loops of course 1 of the preceding or following 4 course rotation in the same wale.

The provision of tuck loops has a tightening effect on the vertical stretchability of the fabric and thus restricts vertical stretch. The formation of the first panty section from the first stitch loop construction gives a relatively large area of the panty front portion with the tuck loop construction designed to limit vertical rise. Conversely, the limited amount of a second stitch loop construction in the rear panty portion allows greater vertical stretch in that area of the garment and thus provides a more precise fit.

In a typical embodiment of the present invention knit on a multi-feed ladies fashion hosiery circular knitting machine, the regular panty portion may contain 140 denier Spandex single covered with 40/13 textured yarn in courses 1 and 3 and 70/34 textured yarn in courses 2 and 4. The first panty section may contain in courses 1 and 3 140 single covered 40/13 textured yarn and in courses 2 and 4 70/34 textured yarn and an additional 40/13 textured yarn. The second panty section may contain 140 single covered 40/13 textured yarn in courses 1 and 3 and 70/34 textured yarn in courses 2 and 4. This same construction with or without the tuck stitch configuration of the second junction, may be used in the run guard 46 traditionally provided in pantyhose garments where the leg portions 26,28 join panty 38.

Other variations of panty garments may be made using the present inventive concept such as girdles, panty dresses and the like. The use of a different stitch loop construction in the front from the back and the use of reinforced yarn thus makes the front panty portion shorter than the back panty portion.

In the drawings and specifications, there has been set forth the best mode presently contemplated for the practice of the present invention. Although specific terms are employed, they are used in a generic and descriptive sense only and not for purposes of limitation, the scope of the invention being defined in the claims.

What is claimed is:

1. A panty garment having panty and waist portions comprising: first and second circularly knit tubes, each tube having a first panty section formed from a multiplicity of courses of a first stitch loop construction and from a reinforced yarn and a second panty section formed from a multiplicity of courses of a second stitch loop construction and from a reinforced yarn, the first panty section being adjacent the second panty section and each of the tubes having a slit proximate the first and second sections forming slit edges, the edges seamed to provide a front panty portion made up of substantially all of the first panty sections of the first and second circularly knit tube and a rear panty portion made up of only the second panty section of the first and second circularly knit tube, the yarns of the multiplicity of courses of the first and second panty sections being knit so that more vertical stretch is experienced in the rear panty section than in the front panty section when the garment is worn.

2. The garment as claimed in claim 1 wherein the second panty section is positioned on the first and second sides of the first panty section.

3. The garment as claimed in claim 1 wherein the first and second tubes are identical in construction and have differing slit edge locations.

4. The garment as claimed in claim 1 wherein the first stitch loop construction comprises a regularly repeating pattern of tuck loops.

5. The garment as claimed in claim 1 wherein the second stitch loop construction comprises a regularly repeating pattern of tuck loops.

6. The garment as claimed in claim 3 wherein the first stitch loop construction comprises a regularly repeating pattern of tuck loops and the second stitch loop construction comprises a different regularly repeating pattern of tuck loops.

7. The garment as claimed in claim 3 wherein the first stitch loop construction comprises a regularly repeating pattern of tuck loops and the second stitch loop construction comprises a different regularly repeating pattern of tuck loops.

8. The garment as claimed in claim 7 further comprising leg and feet portions to form a pantyhose garment.

9. A method of forming a panty garment having panty and waist portions comprising the steps of: forming a pair of circularly knit tubes, each having a first panty section formed from a multiplicity of courses of a first stitch loop construction, and from a reinforced yarn and a second panty section formed from a multiplicity of courses of a second stitch loop construction and from a reinforced yarn, the first panty section being adjacent the second panty section; slitting the tubes along a portion of their length proximate the first and second panty sections to form slit edges; joining the slit edges to provide a front panty portion made up of substantially all of the first panty sections of the first and second tubes and a rear panty portion made up of only the second panty sections of the first and second tubes, the yarns of the multiplicity of courses of the first and second panty sections being knit so that more vertical stretch is experienced in the rear panty section than in the front panty section when the garment is worn.

10. The method as claimed in claim 9 wherein the second panty section is positioned on the first and second sides of the first panty section.

11. The method as claimed in claim 9 wherein the first and second tubes are identical in construction and have differing slit edge locations.

12. The method as claimed in claim 9 wherein the first stitch loop construction comprises a regularly repeating pattern of tuck loops.

13. The method as claimed in claim 9 wherein the second stitch loop construction comprises a regularly repeating pattern of tuck loops.

14. The method as claimed in claim 10 wherein the first stitch loop construction comprises a regularly repeating pattern of tuck loops and the second stitch loop construction comprises a different regularly repeating pattern of tuck loops.

15. The method as claimed in claim 9 including the step of knitting leg and feet portions in each of the tubes to form a pantyhose garment.

* * * * *